US009770067B2

(12) United States Patent
Causey et al.

(10) Patent No.: US 9,770,067 B2
(45) Date of Patent: Sep. 26, 2017

(54) SHOE WITH DETACHABLE HEEL

(75) Inventors: Randall Causey, Arlington, TX (US); Kent Kallsen, Jefferson, WI (US); Jesse Darley, Madison, WI (US); Eric Gobrecht, Madison, WI (US)

(73) Assignee: Uriel Sol, Inc., Arlington, TX (US)

( * ) Notice: Subject to any disclaimer, the term of this patent is extended or adjusted under 35 U.S.C. 154(b) by 662 days.

(21) Appl. No.: 13/189,475

(22) Filed: Jul. 22, 2011

(65) Prior Publication Data

US 2013/0019498 A1 Jan. 24, 2013

(51) Int. Cl.
*A43B 21/36* (2006.01)
*A43B 21/48* (2006.01)
*A43B 21/51* (2006.01)

(52) U.S. Cl.
CPC ..... *A43B 21/36* (2013.01); *A43B 21/48* (2013.01); *A43B 21/51* (2013.01)

(58) Field of Classification Search
CPC ..... A43B 21/36–21/40; A43B 21/51; A43B 21/48; A43B 21/437
USPC ..... 36/42, 34 R, 36 R, 100
See application file for complete search history.

(56) References Cited

U.S. PATENT DOCUMENTS 1,829,252 A * 10/1931 Zubia ..... A43B 21/36 36/42
2,934,840 A * 5/1960 Mistarz ..... 36/34 R
2,943,404 A * 7/1960 Sultan ..... A43B 21/36 36/42
3,174,234 A * 3/1965 Weitzner ..... A43B 3/24 36/1
3,266,177 A * 8/1966 Holden ..... 36/36 C
3,805,418 A * 4/1974 Matuka ..... A43B 21/30 36/34 A
4,805,320 A * 2/1989 Goldenberg et al. ..... 36/42
5,309,651 A * 5/1994 Handel ..... A43B 21/433 36/100
5,524,365 A * 6/1996 Goldenberg ..... 36/42
5,887,360 A * 3/1999 Bucalo ..... A43B 3/24 36/100
6,021,586 A * 2/2000 Bucalo ..... A43B 3/24 36/42
7,185,448 B2 * 3/2007 Schupbach ..... 36/42
7,578,075 B1 * 8/2009 Kemp ..... 36/100
2008/0235991 A1 * 10/2008 Visser ..... 36/100
2009/0183391 A1 * 7/2009 Gallegos ..... A43B 1/0081 36/92

* cited by examiner

*Primary Examiner* — Jila M Mohandesi
(74) *Attorney, Agent, or Firm* — Law Office of Dorian Cartwright; Dorian Cartwright

(57) ABSTRACT

A shoe with a detachable heel includes: a heel post; a heel cladding including an aperture shaped to receive the heel post; and an attachment mechanism secured to the heel cladding, the attachment mechanism including seated within the heel cladding wherein the attachment mechanism includes a button biased towards first position in which the attachment mechanism secures the heel post within the heel cladding and when a force is applied to overcome the bias towards the first position the button translates approximately perpendicular to the heel post to place the attachment mechanism in a second position wherein the heel post is released from within the heel cladding.

15 Claims, 6 Drawing Sheets

SHOE WITH DETACHABLE HEEL

BACKGROUND OF THE INVENTION

The present subject matter relates generally to a shoe with a detachable heel. More specifically, the present invention relates to a woman's high heel shoe, wherein the upper is attached to a sole that includes a heel post, which is releasably secured to a detachable heel.

High heels are ubiquitous in women's fashion and are a popular choice when dressing for many occasions. High heels come in many different styles and colors. While typically considered a dressier shoe, many women own numerous pairs of high heels that may be suitable for a variety of different occasions. Women commonly purchase a variety of styles of high heels shoes to coordinate with various outfits and meet various needs. It would be advantageous to provide a high heel shoe in which the heel portion may be replaced to provide a more versatile shoe.

Due to the inherent structure of a high heel, a lot of pressure is placed on the heel portion of the shoe. Therefore, the heel portion of high heels commonly wears down more quickly than the shoe upper. Accordingly, it would be beneficial to be able to replace just the heel portion of the shoe instead of the entire shoe.

Accordingly, a need exists for a shoe with detachable heel as described and claimed herein.

BRIEF SUMMARY OF THE INVENTION

The present subject matter meets these needs and others by providing a woman's high heel shoe, wherein the upper is attached to a sole that includes a heel post, which the heel post is releasably secured to a detachable heel cladding. The shoe provided herein is functional, sturdy and stylish, and enables the user to detach and replace any of a number of heel claddings to a given shoe upper using a push-button release mechanism.

The heel post is securely fixed to the sole of the shoe. The heel post is the main structural element of the heel and may be formed from a strong structural material, such as steel, titanium, etc. There are two specific variations of the heel post that are used as examples herein. The first heel post is adapted to interlock with a torsion spring attachment mechanism. The second heel post is adapted to interlock with a ratchet attachment mechanism. Both heel posts and their corresponding attachment mechanisms are described in further detail herein.

While also providing some structural support, the detachable heel cladding is primarily an aesthetic element that further provides the elements of the heel most likely to need replacement due to wear. The attachment mechanism for securing the heel cladding to the heel post is incorporated into the detachable heel cladding. The attachment mechanism includes a spring loaded push button release mechanism triggered by a button located within the heel cladding.

As described above, two examples of attachment mechanisms are specifically described herein, though there are numerous alternative attachment mechanisms contemplated and taught by the disclosure provided herein.

The first detailed attachment mechanism is a torsion spring attachment mechanism. The torsion spring attachment mechanism includes a torsion spring having an axial aperture through which the heel post is inserted. The torsion spring cooperates with a push button to open and close the axial aperture to secure and release the heel post. The continuous connection between the torsion spring and the heel post (i.e., there is no specific engagement point, the torsion spring may secure to the heel post anywhere along a given length of the heel post) helps to mitigate any tolerance issues in the manufacturing process and help to close any gap that forms when the user places weight on the shoe thereby pushing the heel post further into the heel cladding.

The second detailed attachment mechanism is a linear ratchet attachment mechanism. The ratchet attachment mechanism includes a ratchet pawl that cooperates with a spring loaded push button to move the pawl between an engaged position and a disengaged position. The cooperating heel post includes ratchet teeth that mate with the ratchet pawl when the pawl is in the engaged position. As the heel cladding is secured to the heel post the ratchet pawl slips over the ratchet teeth on the heel post providing an audible sound, which may help a user identify when the attachment mechanism is making a secure connection.

A shoe with a detachable heel may include: a heel post; a heel cladding including an aperture shaped to receive the heel post; and an attachment mechanism secured to the heel cladding, the attachment mechanism including seated within the heel cladding wherein the attachment mechanism includes a button biased towards first position in which the attachment mechanism secures the heel post within the heel cladding and when a force is applied to overcome the bias towards the first position the button translates approximately perpendicular to the heel post to place the attachment mechanism in a second position wherein the heel post is released from within the heel cladding.

In one embodiment, the attachment mechanism may include a spring loaded button including a tab that contacts a leg of a torsion spring; the torsion spring may grasp a middle section of the heel post when the button is in the first position; the heel post may include a conically tapered section between the middle section and a lower section that mates with a conically tapered section of the aperture in the heel cladding; the aperture in the heel cladding may be an approximately vertical axial aperture; and the heel post may be integrally formed into the sole of the shoe.

In another embodiment, the attachment mechanism may include a pawl arm that interacts with ratchet teeth on the heel post. The pawl arm may be integrally formed with the button. In another embodiment, the heel post may include off-set ratchet teeth on opposing sides of the heel post and the button may be integrally formed with two pawl arms, each pawl arm cooperating with the ratchet teeth on one side of the heel post. Further, the heel post may include a D-shaped section that mates with a D-shaped section in the aperture in the heel cladding.

An advantage of the shoe provide herein is that it enables a user to replace the heel cladding for aesthetic or functional purposes.

Another advantage of the shoe provided herein is that it provides a releasable attachment mechanism for securing the heel post to the heel cladding.

A further advantage of the shoe provided herein is that the heel post, heel cladding and attachment mechanism provide a strong functional heel.

Yet another advantage of the shoe provided herein is that it provides a detachable heel while being conscious of minimizing the additional weight added to the shoe.

Another advantage of the shoe provided herein is that the spatial volume required is minimized to allow the most design flexibility for different heel sizes and fashions.

A still further advantage of the shoe provided herein is that is provides an attachment mechanism where each step taken by the user acts to tighten the attachment of the heel cladding to the heel post.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1:
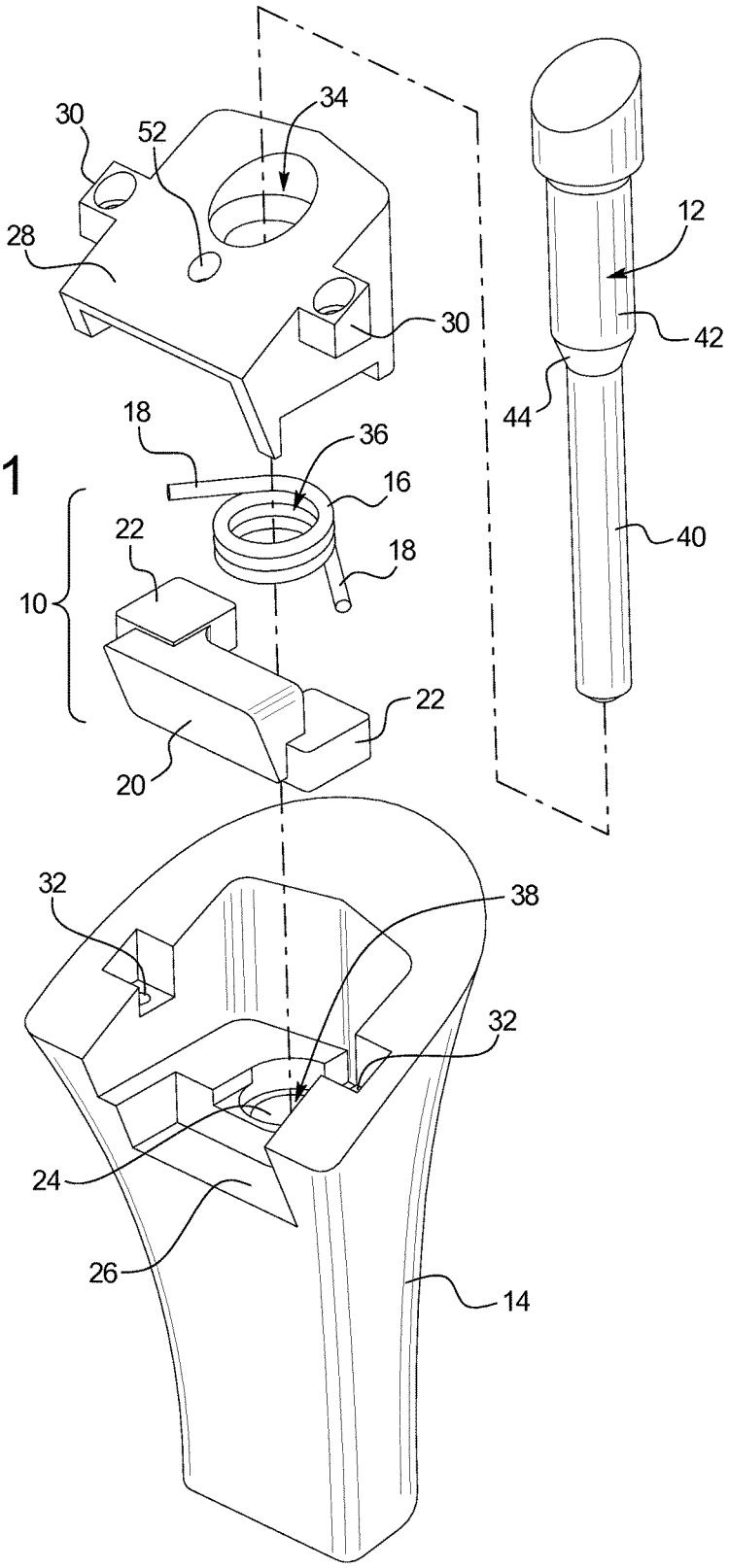
FIG. 1 is an exploded perspective view of a version of a torsion spring attachment mechanism for a shoe as provided herein.

FIG. 1 illustrates an example of an attachment mechanism 10 for securing a heel post 12 and a detachable heel cladding 14. As shown in the example provided in FIG. 1, the attachment mechanism 10 includes a torsion spring 16 having a pair of legs 18 that mate with a button 20. The button 20 includes a pair of tabs 22 for contacting and interacting with the legs 18 of the torsion spring 16.

When assembled, the torsion spring 16 sits within a spring seat 24, the button 20 sits within a button seat 26 and a cap 28 is secured to the heel cladding 14 to contain the elements of the attachment mechanism 10 within the heel cladding 14. In the example shown in FIG. 1, the cap 28 is secured to the heel cladding 14 by way of screws threaded through the cap wings 30 and into the receiving holes 32 in the heel cladding 14. The heel post 12 may then be inserted into the heel cladding 14 through the cap aperture 34, through the spring aperture 36 in the torsion spring 16 and into the heel cladding aperture 38.

In use, the torsion spring 16 secures the heel post 12 within the heel cladding 14. When the button 20 is depressed, the tabs 22 push against the legs 18 of the torsion spring 16 to expand the diameter of the spring aperture 36, allowing the heel post 12 to be freely inserted or removed from the heel cladding aperture 38. Then, when the button 20 is released, the legs 18 of the torsion spring 60 push the button 20 outward, which decreases the diameter of the spring aperture 36. When the heel post 12 is inserted through the spring aperture 36, the torsion spring 16 securely grasps the heel post 12 to retain the heel cladding 14 on the heel post 12. While in the example shown in FIG. 1 the button 20 is returned to the at rest position by the force of the torsion spring 16, it is contemplated that in alternative versions, the button 20 may be biased to the at rest position by one or more dedicated basing springs. In another alternate embodiment, one leg 18 of the torsion spring 20 is fixed in position, such that only one tab 22 interacts with one leg 18 of the torsion spring 16, thereby simplifying the operation of the attachment mechanism 10.

In the example shown in FIG. 1, the heel post 12 includes three distinct cylindrical sections with varied diameters. A narrow diameter lower section 40 transitions to a larger diameter middle section 42 along a conically tapered transition 44. The heel cladding aperture 38 may be shaped to correspond to the conically tapered transition 44 to help align the heel post 12 within the heel cladding aperture 38. However, it is contemplated that in other embodiments, the post 20 may have a different shape, as long as it corresponds to the space in the detachable heel 18. Additional conical sections may be provided to assist in the alignment of the heel post 12 and the heel cladding 14.

Figure 2:
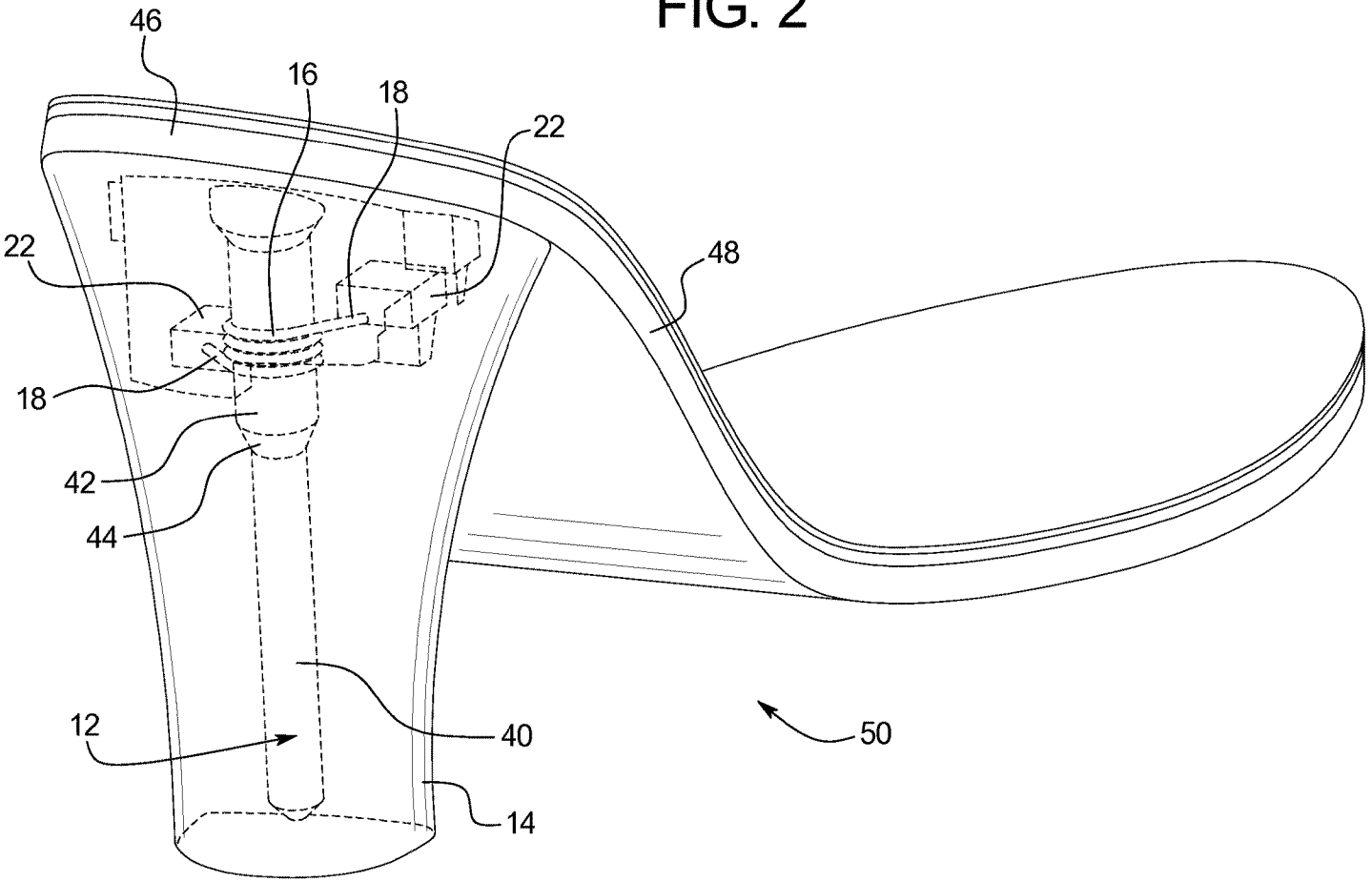
FIG. 2 is a perspective view of a shoe incorporating the torsion spring attachment mechanism illustrated in FIG. 1.
Figure 3:
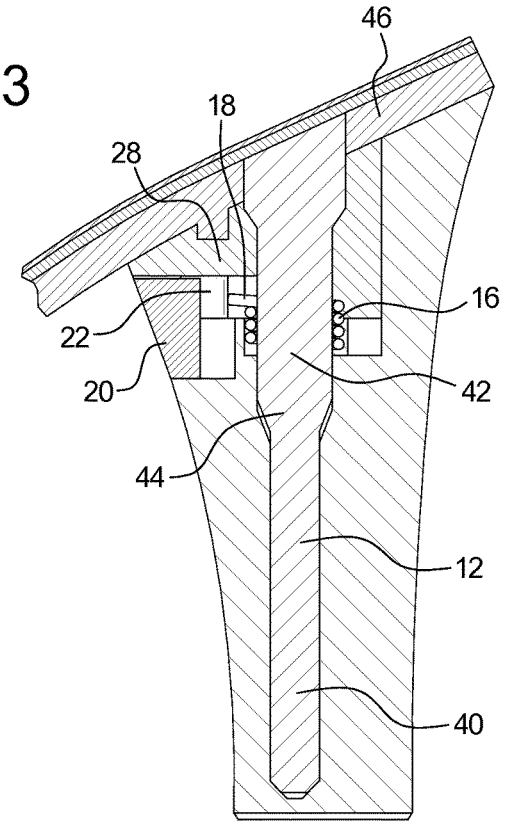
FIG. 3 is a cross-sectional side view of the heel portion of the shoe shown in FIG. 2.
Figure 4:
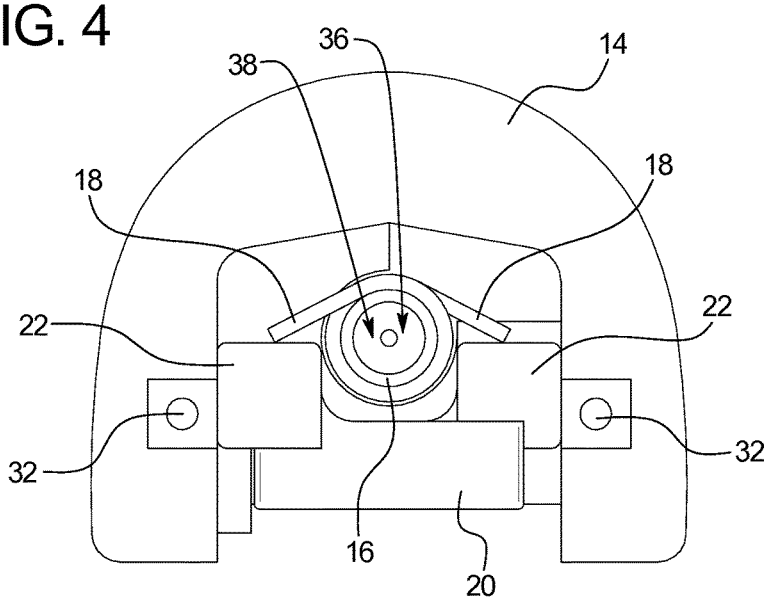
FIG. 4 is a cross-sectional top view of the heel portion of the shoe shown in FIG. 2.

Turning now to FIG. 2, the heel post 12, the heel cladding 14 and the various elements of the attachment mechanism 10 are shown assembled at the bottom of the heel section 46 of a sole 48 of a high heel shoe 50. Similarly, FIG. 3 illustrates a cross-sectional side view of the assembled components. FIG. 4 shows a top view of the assembled components. The views provided in FIGS. 2-4 compliment the exploded view shown in FIG. 1 and further illustrate how the components cooperate to form the assembled high heel shoe. 50.

In the example of the attachment mechanism 10 and heel post 12 shown in FIGS. 1-4, the heel post 12 is cylindrically symmetrical, which may cause some difficulty in aligning the heel cladding 14 appropriately on the sole 48 of the shoe 50. Accordingly, as shown in FIG. 1, the cap 28 may include an alignment hole 52 through which a corresponding alignment pin 62 (FIG. 7) attached at the heel section 46 of the sole 48 may be inserted to ensure proper alignment between the heel cladding 14 and the sole 48. Of course, the alignment issues may be managed any of a number of ways, whether through other alignment hole/pin combinations or by varying the shape of the heel post 12 and the corresponding heel cladding aperture 38. For example, the lower section 40 of the heel post 12 and corresponding heel cladding aperture 38 may be generally triangular in cross-section, while the middle section 42 may be generally circular to most appropriately mate with the torsion spring 16.

Figure 5:
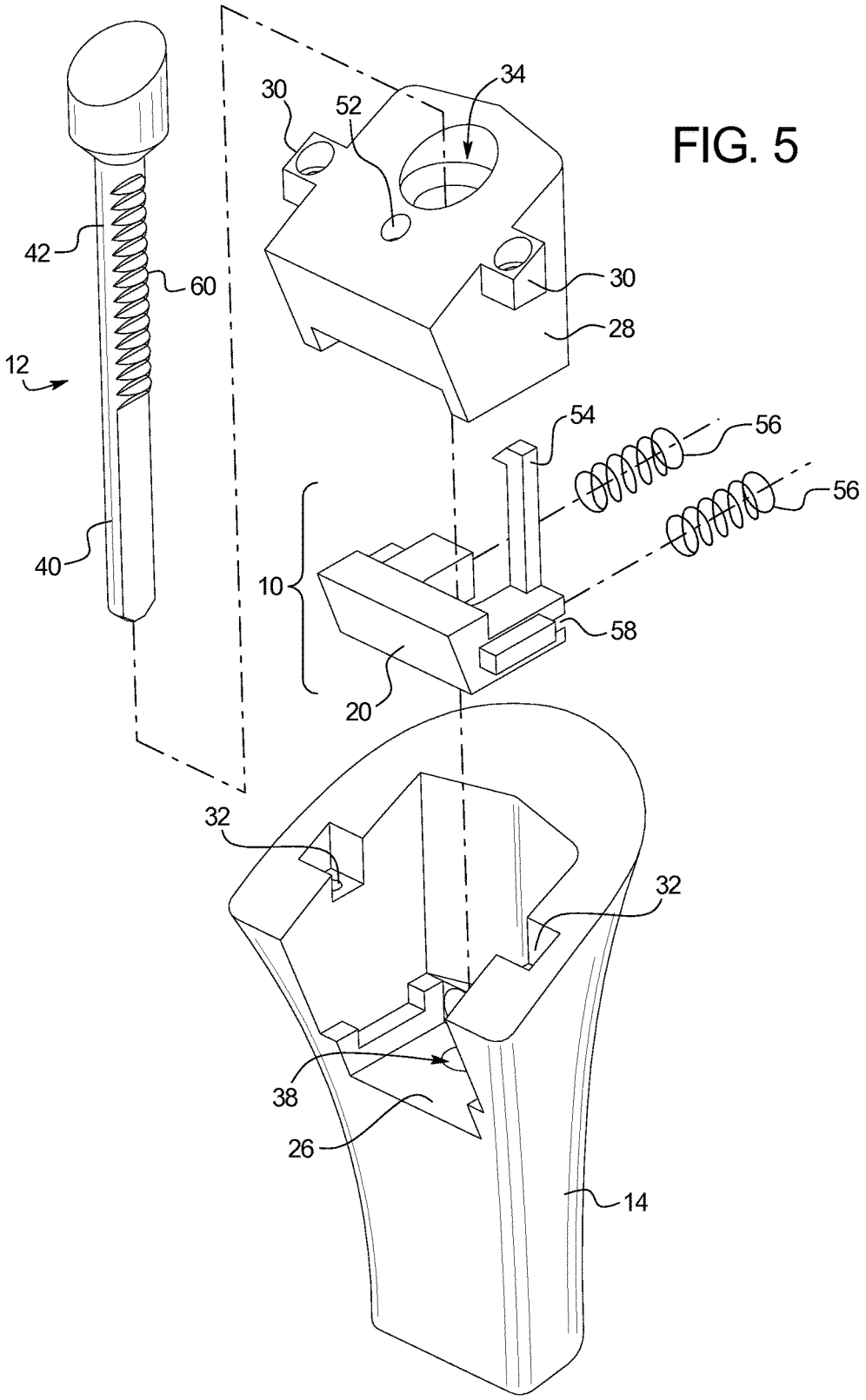
FIG. 5 is an exploded perspective view of a version of a linear ratchet attachment mechanism for a shoe as provided herein.

Turning now to FIG. 5, another example of an attachment mechanism 10 for securing a heel post 12 and a detachable heel cladding 14 is shown. In the example provided in FIG. 5, the attachment mechanism 10 relies on a linear ratchet mechanism rather than a torsion spring mechanism to effect the releasable engagement between the heel post 12 and the detachable heel cladding 14. However, many of the elements from the example shown in FIGS. 1-4 are also used in the example shown in FIG. 5. Such elements are marked with the same numbers used in FIGS. 1-4. The features and functions of many of these elements will not be described again with reference to FIG. 5 to avoid unnecessary repetition.

As shown, the attachment mechanism 10 shown in FIG. 5 includes a button 20 including a pawl arm 54 fixed to the body of the button 20. In addition, the attachment mechanism 10 includes a pair of springs 56 which are used to bias the button within the button seat 26 in the heel cladding 14. Each of the springs 56 seat within corresponding spring chambers 58 in the button 20 such that the springs 56 extend outward out from the spring chambers 58 from the back of the button 20 when no force is applied to the button 20 and then compress within the spring chambers 58 when a user applies force to the button 20.

Figure 6:
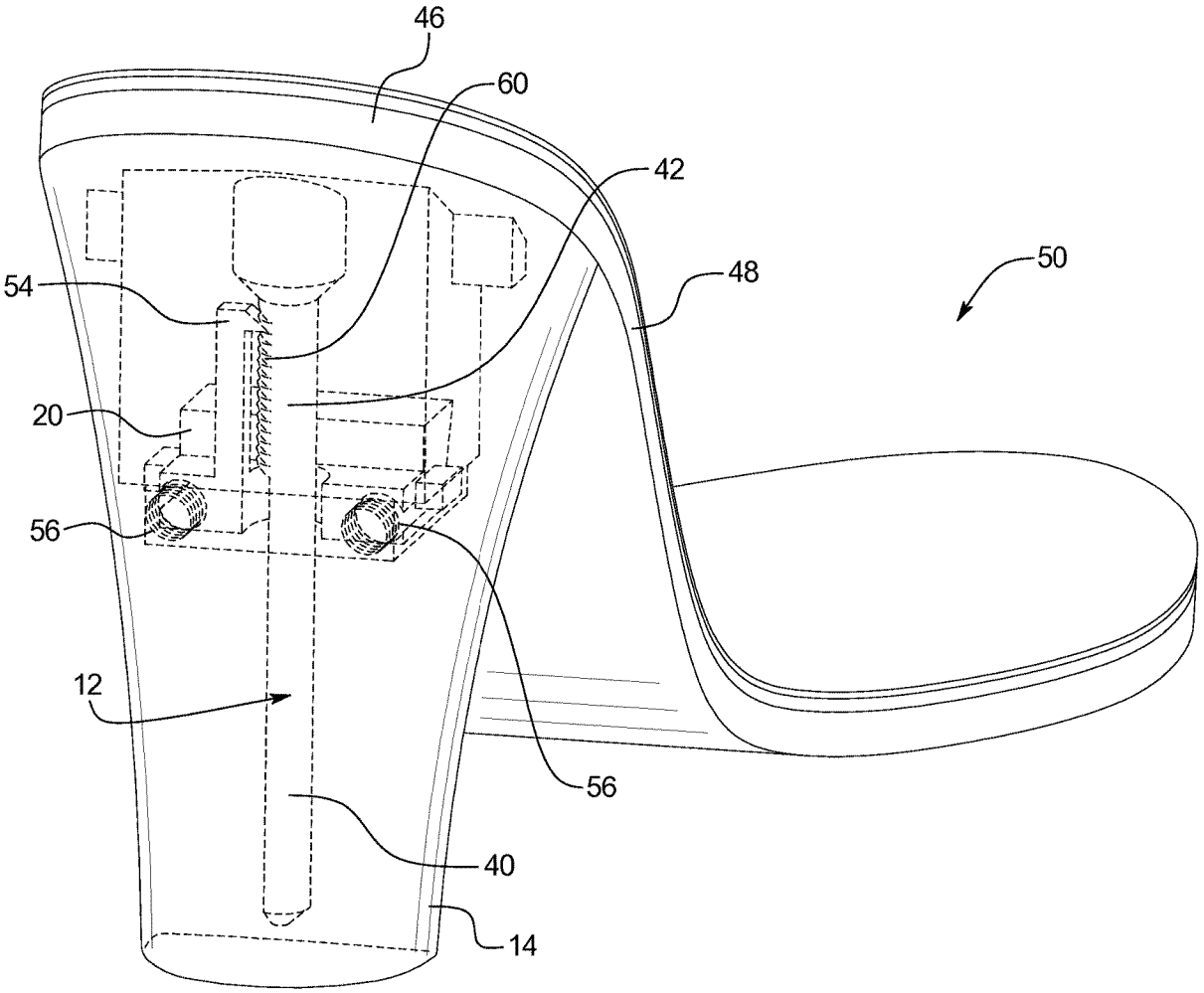
FIG. 6 is a perspective view of a shoe incorporating the linear ratchet attachment mechanism illustrated in FIG. 5.
Figure 7:
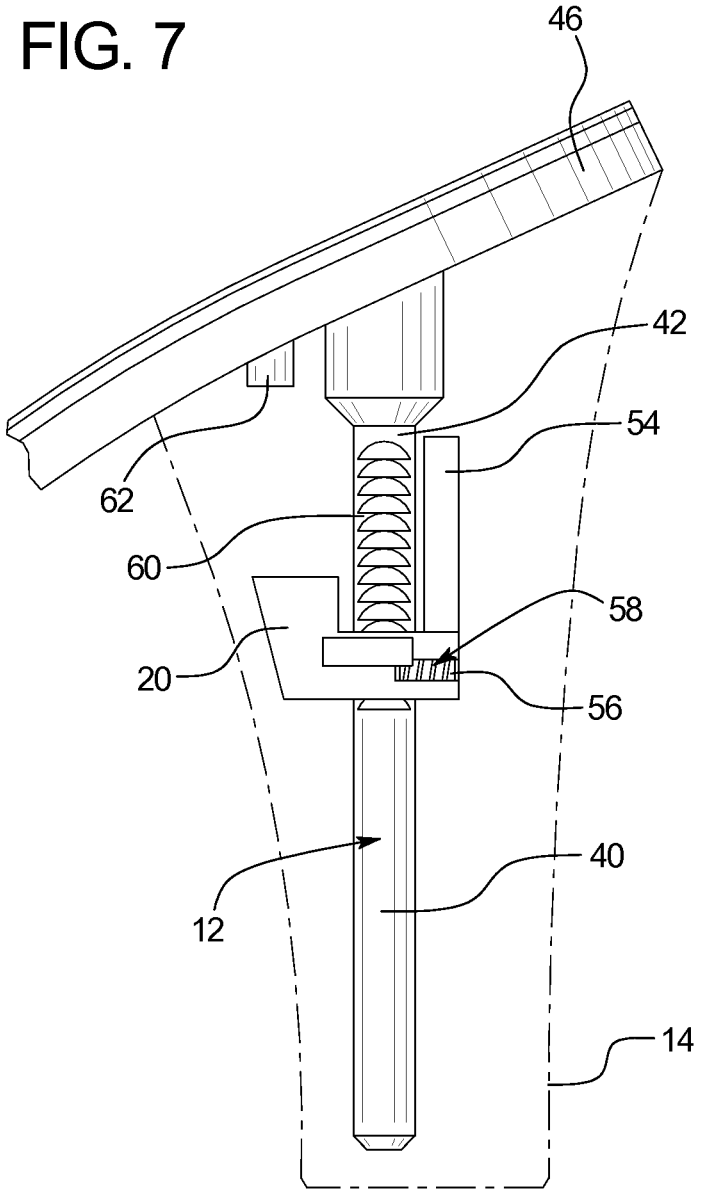
FIG. 7 is a cutaway side view of the heel portion of the shoe shown in FIG. 6.

The middle section 42 of the heel post 12 shown in FIG. 5 includes a series of ratchet teeth 60 for mating with the pawl arm 54. When the heel post 12 is inserted into the heel cladding 14, the pawl arm 54 engages one of the ratchet teeth 60 to secure the heel post 12 to the heel cladding 14, as shown in FIG. 6. Then, when a user applies force to the button 20 to compress the springs 56 and disengage the pawl arm 54, as shown in FIG. 7, the heel post 12 may be removed from the heel cladding 14.

The number and spacing of the ratchet teeth 60 dictate the degree to which the attachment mechanism 10 may fine tune the interface between the heel cladding 14 and the sole 48. A greater number of ratchet teeth 60 within a given distance may help to decrease backlash. The size of the teeth 60 may also affect the strength of the connection between the heel post 12 and the heel cladding 14. Accordingly, it may be impractical to have too finely spaced ratchet teeth 60. Therefore, it is contemplated that the button 20 may include a pair of pawl arms 54 adapted to interact with a corresponding two sets of ratchet teeth 60 on opposite sides of the heel post 12 (i.e., dual out-of-phase pawl arms 54). The two sets of ratchet teeth 60 may be offset from each other to effectively improve the adjustability by a factor of two, without sacrificing the size of the ratchet teeth 60.

As further shown in FIG. 5, the lower portion 40 of the heel post 12 may be approximately D-shaped in cross-section, to mate with a corresponding D-shaped heel cladding aperture 38. Accordingly, the heel post 12 and heel cladding aperture 38 may aid in alignment of the heel cladding 14 on the shoe 50. As additionally shown in FIG. 7, and described above with respect to FIGS. 1-4, an alignment pin 62 may be used to align the heel cladding 14 through cooperation with a corresponding alignment hole 52 in the cap 28.

The examples of the attachment mechanism 10 described with respect to FIGS. 1-7 are merely illustrative examples of the attachment mechanisms taught herein. It is understood that many variations are possible without departing from the scope and teachings provided herein. It should be noted that various changes and modifications to the presently preferred embodiments described herein will be apparent to those skilled in the art. Such changes and modifications may be made without departing from the spirit and scope of the present invention and without diminishing its attendant advantages.

We claim:

1. A shoe with an interchangeable aesthetic portion of a heel, comprising:

a sole; and a heel, comprising:

a heel post that is securely fixed to the sole of the shoe to provided primary structural support for the heel;

an alignment pin that is securely fixed to the sole of the shoe;

an interchangeable heel cladding including an aperture shaped to receive the heel post and an alignment hole to receive the alignment pin when attached, and a push button release, the interchangeable heel cladding being a primary aesthetic element of the heel; and an attachment mechanism secured to the interchangeable heel cladding, the attachment mechanism seated within the heel cladding and the push button release including a button biased towards a first position in which the attachment mechanism secures the heel post within the interchangeable heel cladding and when an inward force is applied to overcome the bias towards the first position the button translates approximately perpendicular to the heel post to place the attachment mechanism in a second position wherein the heel post is released from within the interchangeable heel cladding, wherein the heel post remain securely attached to the shoe sole to provide structural support for the heel after the interchangeable heel has been released.

2. The shoe of claim 1 wherein the attachment mechanism includes a torsion spring.

3. The shoe of claim 2 wherein the button includes a tab in contact with a leg of the torsion spring.

4. The shoe of claim 2 wherein the torsion spring grasps a middle section of the heel post when the button is in the first position.

5. The shoe of claim 1 wherein the heel post includes a conically tapered section between the middle section and a lower section that mates with a conically tapered section of the aperture in the heel cladding.

6. The shoe of claim 1 wherein the button is spring loaded.

7. The shoe of claim 1 wherein the aperture in the heel cladding is an approximately vertical axial aperture.

8. The shoe of claim 1 wherein the heel post is integrated into the heel of the shoe.

9. The shoe of claim 1 wherein the attachment mechanism includes a pawl arm that interacts with ratchet teeth on the heel post.

10. The shoe of claim 9 wherein the pawl arm is integrally formed with the button.

11. The shoe of claim 1 wherein the heel post includes a D-shaped section that mates with a D-shaped section in the aperture in the heel cladding.

12. The shoe of claim 1, wherein the heel post comprises a structural material that is stronger than a material of the detachable heel cladding.

13. The shoe of claim 1, wherein the detachable heel cladding is one of a plurality of detachable heel claddings, each of which secures to the heel post using the attachment mechanism.

14. The shoe of claim 1, wherein the heel post extends through a majority of the heel.

15. The shoe of claim 1, wherein the heel post extends vertically from the sole more than halfway to the bottom of the heel.

* * * * *